United States Patent [19]

Carey et al.

[11] Patent Number: 5,067,560

[45] Date of Patent: Nov. 26, 1991

[54] CONDENSER COIL ARRANGEMENT FOR REFRIGERATION SYSTEM

[75] Inventors: Michael D. Carey, Holmen; William A. Smiley, III, Stoddard; Gerald A. Jansky, La Crosse, all of Wis.

[73] Assignee: American Standard Inc., New York, N.Y.

[21] Appl. No.: 653,836

[22] Filed: Feb. 11, 1991

[51] Int. Cl.[5] ..... F25B 39/04

[52] U.S. Cl. ..... 165/124; 165/122

[58] Field of Search ..... 165/122, 124; 29/890.035

[56] References Cited

U.S. PATENT DOCUMENTS 2,401,918 6/1946 Elder et al. ..... 165/122
3,857,253 12/1974 Burgett et al. ..... 62/289
4,470,271 9/1984 Draper et al. ..... 62/259.1
4,757,858 7/1988 Miller et al. ..... 165/41

FOREIGN PATENT DOCUMENTS 464531 4/1937 United Kingdom ..... 165/124

OTHER PUBLICATIONS

Trane Publication "Air Cooled Condensers, 20 through 120 Tons", ACDS-DS-1, Jun. 1989.

*Primary Examiner*—Allen J. Flanigan
*Attorney, Agent, or Firm*—William J. Beres; William O'Driscoll

[57] ABSTRACT

A condenser for an air conditioning or refrigeration system having first, second, third and fourth condenser coils arranged in a modified "W" arrangement.

23 Claims, 4 Drawing Sheets

CONDENSER COIL ARRANGEMENT FOR REFRIGERATION SYSTEM

BACKGROUND OF THE INVENTION

The present invention is directed to a condenser for an air conditioning system, and more particularly, to an optimal condenser coil arrangement which provides high condenser airflow efficiency even when either of two air inlets is completely obstructed.

Previous condenser have had various coil arrangement when viewed from a longitudinal end of the condenser housing. Typically air inlets are provided on either side of the condenser housings with coils located within and fans located on top of the housing so that air enters from the sides, passes over condenser coils and exits upwardly through the fans. Previous condenser coil arrangements have suffered airflow efficiency losses approaching 50% whenever either of the side air inlets is completely obstructed, and have suffered proportional airflow efficiency reduction when either of the side inlets is partially obstructed.

For instance in a "U" shaped coil arrangement such as shown in U.S. Pat. No. 3,857,253, air enters from either side of the condenser housing either directly through the upright legs of the "U" or through air inlets located below the legs of the "U". After entering the air inlets, the air makes an abrupt 90 degree turn and passes through a condenser coil forming the base of the "U". This abrupt 90 degree turn results in an uneven air distribution and variable face velocity across the condenser forming the base of the "U". The bulk of the airflow is concentrated at the central portion of the "U"'s base. Should an obstruction such as a wall or another condenser be placed parallel to either side of the condenser so as to block the air inlets on that side, the loss of airflow coupled with the inefficiencies of the abrupt 90 degree turn result in an overall reduction in airflow efficiency approaching 50%.

Another condenser coil arrangement can be seen in applicant's publication "Air Cooled Condensers, 20-120 Tons". This publication shows a "V" arrangement where air enters from either side, passes through one or the other of the legs of the "V", and exits in an upward direction. The legs of the "V" extend essentially from the top to the bottom of the condenser housing. If an obstruction blocks either air inlet, air does not flow through that particular leg of the "V". Consequently, airflow efficiency is reduced by 50% if the obstruction completely blocks the inlet, and is reduced in proportion to the obstruction's distance from the air inlet if the obstruction does not completely block the inlet.

A third condenser coil arrangement presently utilized is a "deep W" which includes a pair of "V" coils forming a "deep W" extending from the housing top to the housing bottom. The outside legs of the "deep W" are similar to the "V" arrangement in that airflow enters from the sides of the housing passes over the coils and exits in an upward direction through the condenser fans. The inner legs of the "deep W" differ in that airflow enters from at least one of the longitudinal ends of the condenser housing through the relatively small triangular area formed between the housing base and the inner legs of the "deep W" This relatively small triangular area has limited airflow efficiency across the condenser coils forming the inner legs of the "deep W" arrangement. If an obstruction blocks or retards airflow from either of the side inlets across one of the exterior legs of the "deep W", airflow efficiencies can approach 50% reduction when the inefficient airflow across the inner legs of the "deep W" is also accounted for.

The primary solution taken previously to preventing reduced airflow efficiencies is to ensure a minimum clearance around the condenser housings. This clearance is recommended to be at least 6 feet. Often this is not feasible in view of the typical location of a condenser housing on a roof top. Sound barriers, decorative sight barriers, pit locations, walls, other condenser housings, or air downflow geometries often prevent optimal location and clearance around the condenser housings.

SUMMARY OF THE INVENTION

It is an object, feature and advantage of the present invention to provide a condenser coil arrangement which solves the problems of the previous condenser coil arrangements.

It is an object, feature and advantage of the present invention to provide a condenser coil arrangement which maximizes airflow efficiencies when an air inlet is blocked.

It is an object, feature and advantage of the present invention to provide a condenser coil arrangement which reduces minimum clearance requirements around the condenser housing.

It is an object, feature and advantage of the present invention to provide a condenser coil arrangement which provides maximum efficiency when clearance around a condenser housing is no more than 4 feet.

It is an object, feature and advantage of the present invention to eliminate abrupt 90 degree airflow turns within the condenser housing.

It is an object, feature and advantage of the present invention to provide constant face velocity across the condenser coils.

It is an object, feature and advantage of the present invention to eliminate areas of poor airflow caused by locating condenser coils in physical proximity.

It is an object, feature and advantage of the present invention to eliminate the lower pinched "V".

It is an object, feature and advantage of the present invention to provide physical support between the condenser coils.

It is an object, feature and advantage of the present invention to allow close spacing of several condenser housings without affecting performance.

It is an object, feature and advantage of the present invention to arrange the inner condenser coils to allow gentle turning of airflow.

It is an object, feature and advantage of the present invention to locate the condenser coils in an upper portion of the condenser housing.

It is an object, feature and advantage of the present invention to provide a modified condenser coil arrangement which has 75% airflow efficiency across the condenser coils even when 50% of the air inlets are blocked.

The present invention provides a condenser for an air conditioning or refrigeration system having first, second, third and fourth condenser coils arranged in a modified "W" arrangement.

The present invention provides a condenser. The condenser comprises a housing having a first and a second side and first, second, third and fourth condenser coils located in the housing. The first coil is located in the first side of the housing, and the fourth coil is located in the second side of the housing. The second coil is inwardly spaced from the first coil and the third coil is inwardly spaced from the fourth coil. The second and third coil are separated a greater distance from each other at their respective lower ends than at their respective upper ends.

The present invention provides a condenser for a refrigeration system. The condenser comprises a housing including first and second air inlets; four condenser coils located in the housing; and means for circulating air where three of the four coils are provided with air by either of the first or second air inlets.

The present invention provides a condenser arrangement for a refrigeration unit. The condenser arrangement comprises a housing having a top, a first side and a second opposing side; a plurality of fans located in the top of the housing; a first air inlet located in the first side of the housing; a second air inlet located in the second side of the housing; and first, second, third and fourth condenser coils arranged in a "W" shape when viewed from an axial direction. The first and fourth coils are respectively located in the first and second housing sides and the first and fourth coils are substantially vertical.

The present invention provides a air cooled chiller for an air conditioning system. The chiller comprises a condenser having air inlets on opposing sides and four condenser coils arranged in a modified "W" arrangement. The condenser operates at 100% efficiency when either of the air inlets is located approximately four feet from an airflow obstruction.

The present invention provides a method of assembling a condenser having a housing including a top, first and second opposing sides, and first, second, third and fourth condenser coils. The method comprises the steps of: locating the first coil in the first side substantially perpendicular to the top; locating the fourth coil in the second side substantially perpendicular to the top; and locating the second and third coils between the first and fourth coils such that the second and third coils are arranged in an inverted "V".

DETAILED DESCRIPTION OF THE INVENTION

Figure 1:
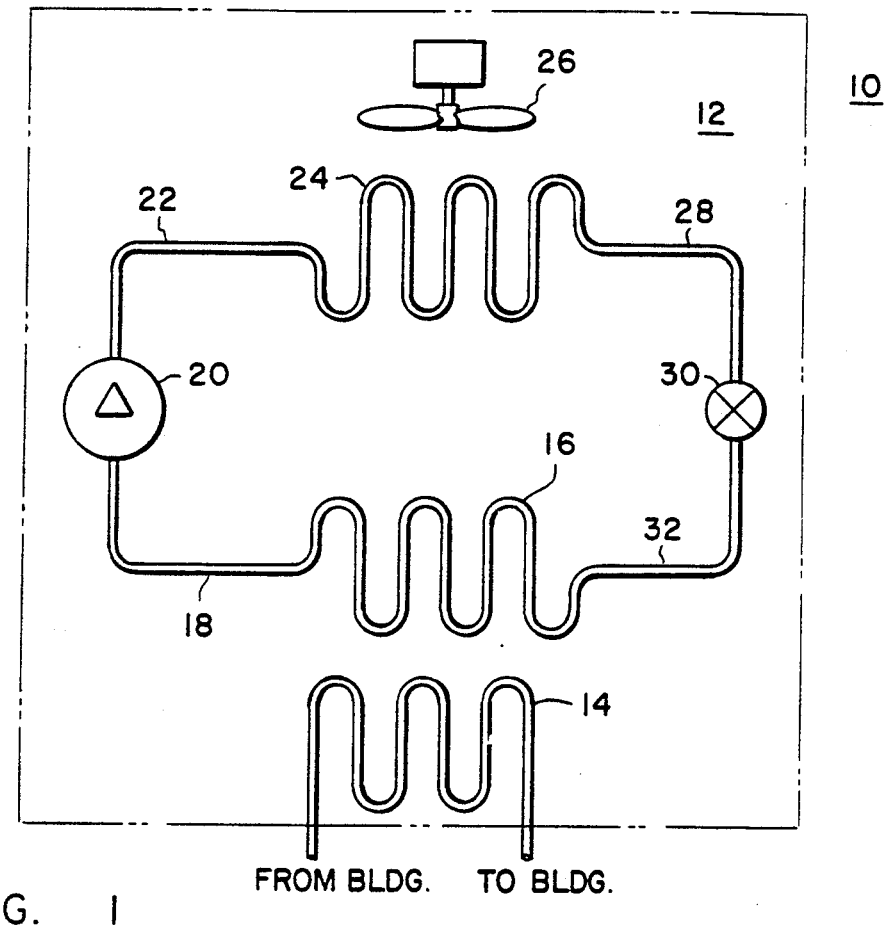
FIG. 1 shows a refrigeration system to which the present invention applies.

FIG. 1 shows an air conditioning system 10 to which the present invention applies. The air conditioning system 10 includes a chiller 12 which is typically located on the outside of a building and cools water transported to and from the chiller 12 by a conventional water transport system 14. The chiller 12 includes an evaporator 16 which excepts heat from the chilled water transport system 14 vaporizing liquid refrigerant in the process. A conduit 18 directs the vaporized refrigerant to a compressor 20 which compresses the vaporized refrigerant thereby lowering its condensing temperature. Another conduit 22 directs the compressed refrigerant to a condenser 24 where a plurality of condenser fans provide airflow to transfer heat from the compressed refrigerant to the air passing over the condenser and thereby condense the compressed refrigerant into a liquid. Conduit 28 directs the liquid refrigerant to an expansion valve 30 which restricts the passage of liquid refrigerant back to the evaporator by means of a conduit 32 in accordance with conventional system design.

Figure 2:
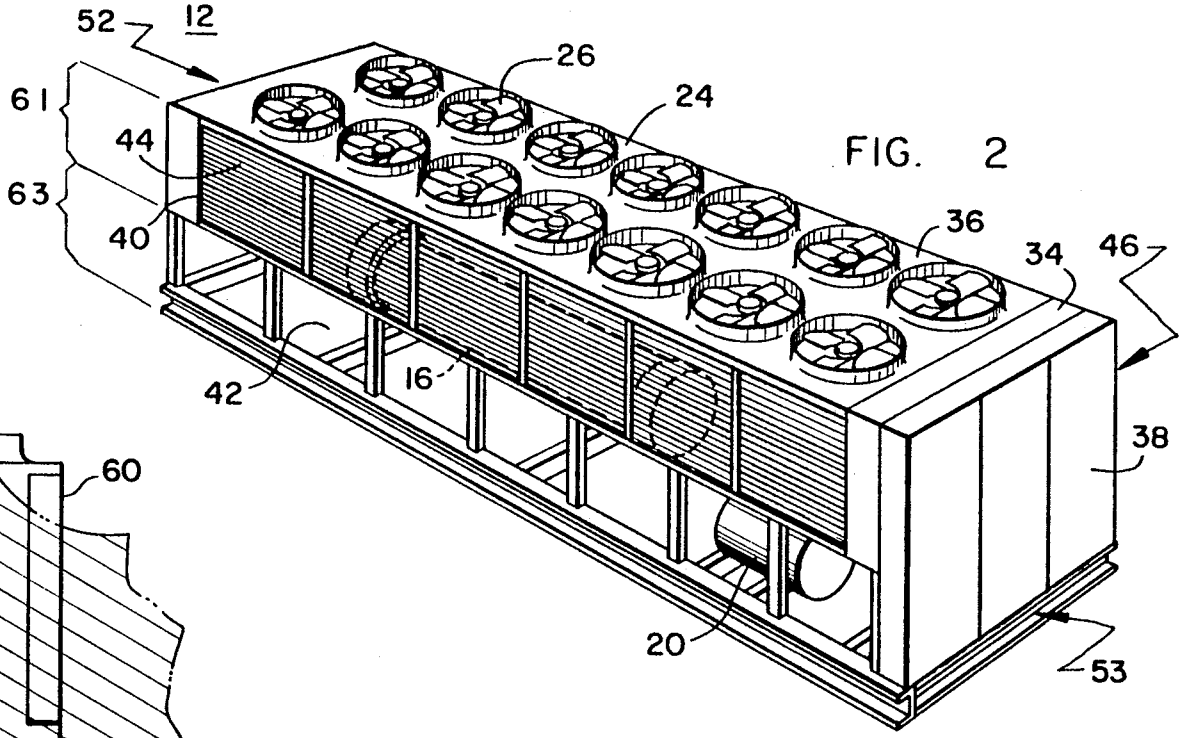
FIG. 2 shows a perspective view of an air cooled chiller unit including a condenser housing incorporating the present invention.

FIG. 2 shows a perspective view of the chiller 12 including the evaporator 16, the compressor 20, and the condenser fans 26. FIG. 2 also shows the housing 34 of the condenser 20 including the housing top 36, a first longitudinal end 38, a first side 40 including an air inlet 42 and a condenser coil 44. A second side 46 is not shown but includes a second air inlet 48 and a condenser coil 50. The condenser housing includes a second longitudinal end 52 and a base 53.

Figure 3:
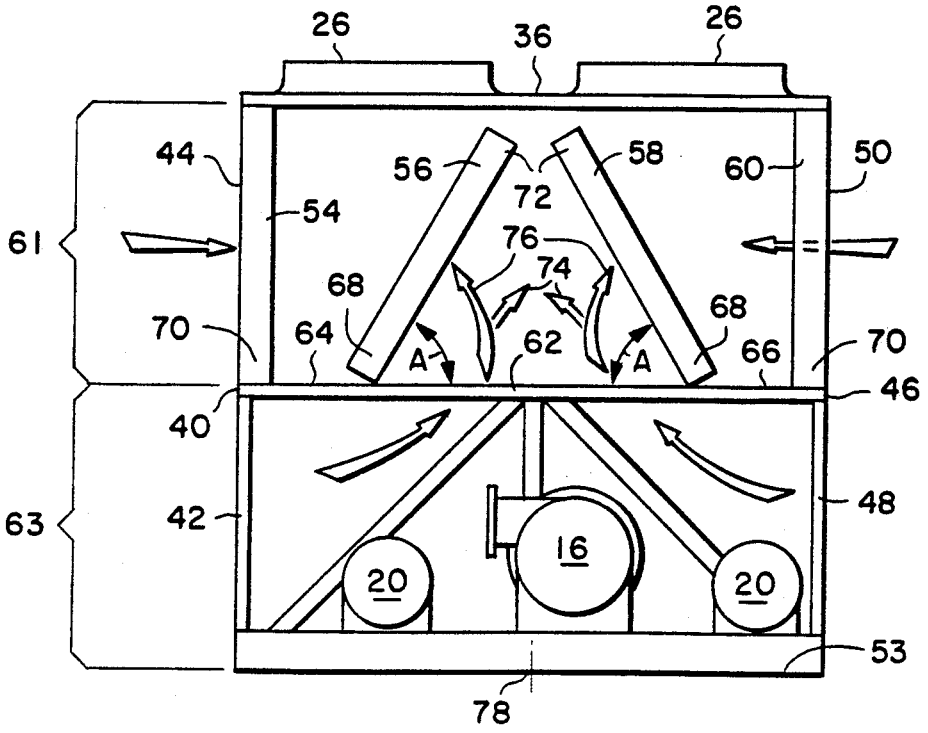
FIG. 3 is a longitudinal view of the chiller unit of FIG. 2 showing the present invention.
Figure 6:
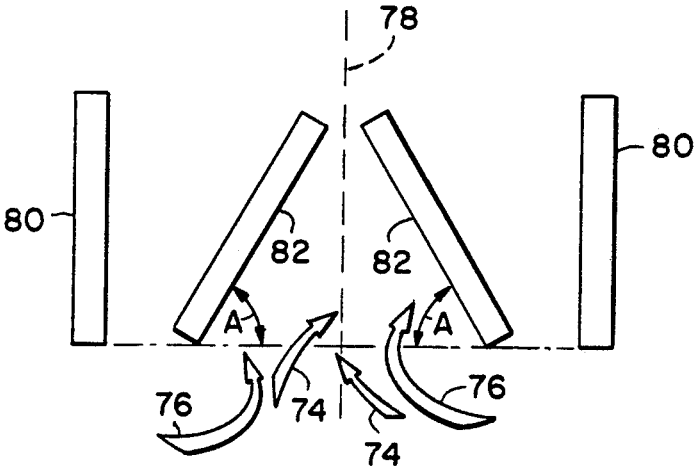
FIG. 6 is a block diagram of the modified "W" condenser coil arrangement of the present invention.
Figure 7:
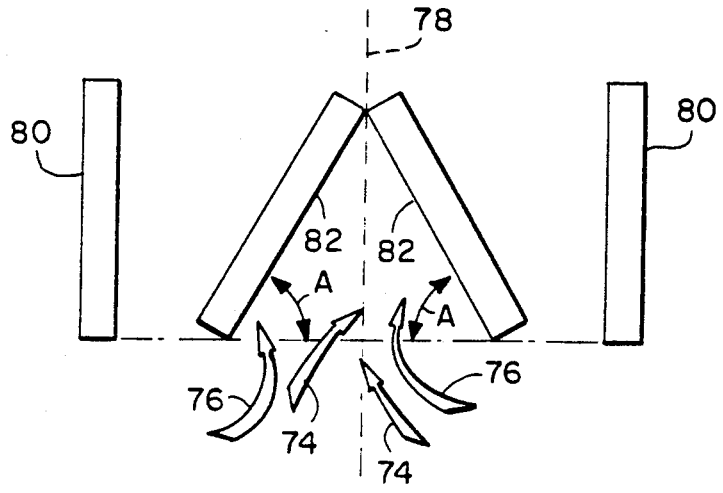
FIG. 7 is a block diagram of the condenser coil arrangement of the present invention.

FIG. 3 shows a view of the chiller 12 from the first longitudinal end 38 in a preferred embodiment which includes a pair of compressors 20, connected in parallel or in separate circuits, and an evaporator 16. Air inlets 42 and 48 are shown respectively on condenser housing sides 46 and 40 and are respectively located below condenser air inlets 44 and 50. Two rows of condenser fans 26 are located on the housing top 36. This figure, as well as FIG. 6, shows the modified "W" condenser coil arrangement of the present invention. This modified "W" arrangement includes four condenser coils 54. 56. 58 and 60 substantially arranged in an upper portion 61 of the condenser housing 34 and not located in a lower portion 63 of the condenser housing 34. The modified "W" arrangement differs from the previous "deep W" arrangement in a number of ways including the fact that the exterior coils 54, 60 forming the exterior legs 80 of the modified "W" are substantially perpendicular, and that all of the coils 54, 56, 58, 60 of the modified "W" extend from the housing top 36 to a support 62 approximately half way between the top 36 and the base 53, this support 62 presenting a line of demarcation between the upper housing portion 61 and the lower housing portion 63. This is unlike the "deep W" where the legs of the "deep W" extend substantially from the top 36 to the base 53 of the housing essentially including both the upper and lower housing portions.

In the modified "W" arrangement of present invention a first condenser coil 54 forms an exterior leg 80 of the modified "W" and is substantially perpendicular to the base 53 of the housing 12. The condenser coil 54 forms a part of the first side 40 of the housing 12 thereby lending support to that side 40. The condenser coil 54 receives airflow through the condenser air inlet 42. Similarly, a fourth condenser coil 60 is substantially perpendicular to the base 53 and forms an exterior leg 80 of the modified "W" and lends support to the second side wall 46. This condenser coil 60 receives airflow through the inlet 50.

The second and third condenser coils 56 and 58 form the inner legs 82 of the modified "W" condenser coil arrangement. Each of these coils 56, 58 is separated from the respective exterior coils 54, 60 by a space 64, 66. The dimension of this space 64, 66 is directly proportional both to the rate of condenser airflow and to the height of the exterior coils 54, 60. The space 64. 66 has a minimum dimension to prevent impinging airflows from the lower portion of the condensers 56, 58 from impinging on and interfering with airflow from the lower portion 70 of the condenser coils 54, 60. The condenser coils 56, 58 are also slanted towards each other such that a top portion 72 of each coil 56. 58 is in closer proximity than the bottom portion 68 of each coil 56, 58. The top portion 72 of these coils 56, 58 can connect, if desired, because the airflow through the top portion 72 of these coils 56, 58 is separating rather than impinging.

The tilt angle A of the coils 56. 58 relative to the support structure 62 or the base 54 is approximately 60 degrees but can range between 45 and 75 degrees if desired. This angle allows airflow from either air inlet 42. 48 to enter and flow directly to the opposite coil 56, 58 as shown by arrows 74, or to gradually turn and enter the closer coil 56, 58 as shown by arrow 76. Additionally, the condenser housing is bilaterally symmetrical about a line 78 with the exception of the evaporator 16.

The advantage of the modified "W" design is that if airflow from either side 40 or 46 is partially or completely obstructed, each of the second and third coils 56, 58 will continue to operate at full efficiency with airflow from either air inlet 42, 48. Additionally, the unobstructed air inlet 44, 50 will allow either exterior coil 54 or exterior coil 60 to also continue to operate at full efficiency. This means that even though an obstruction blocks 50% of the air inlets, the condenser coils 54, 56, 58, 60 will continue to operate at least 75% efficiency.

Figure 4:
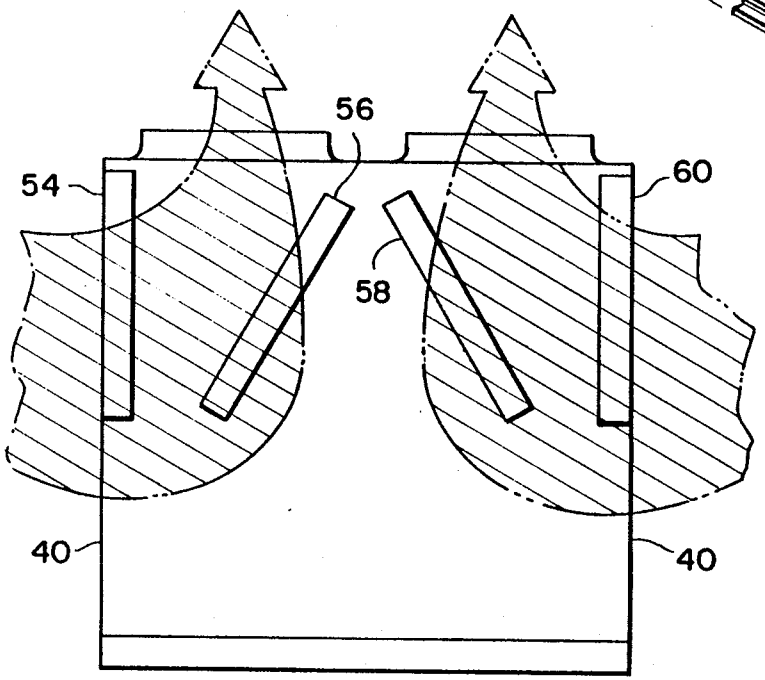
FIG. 4 is an operational view of the coil arrangement of FIG. 3 showing normal operation.
Figure 5:
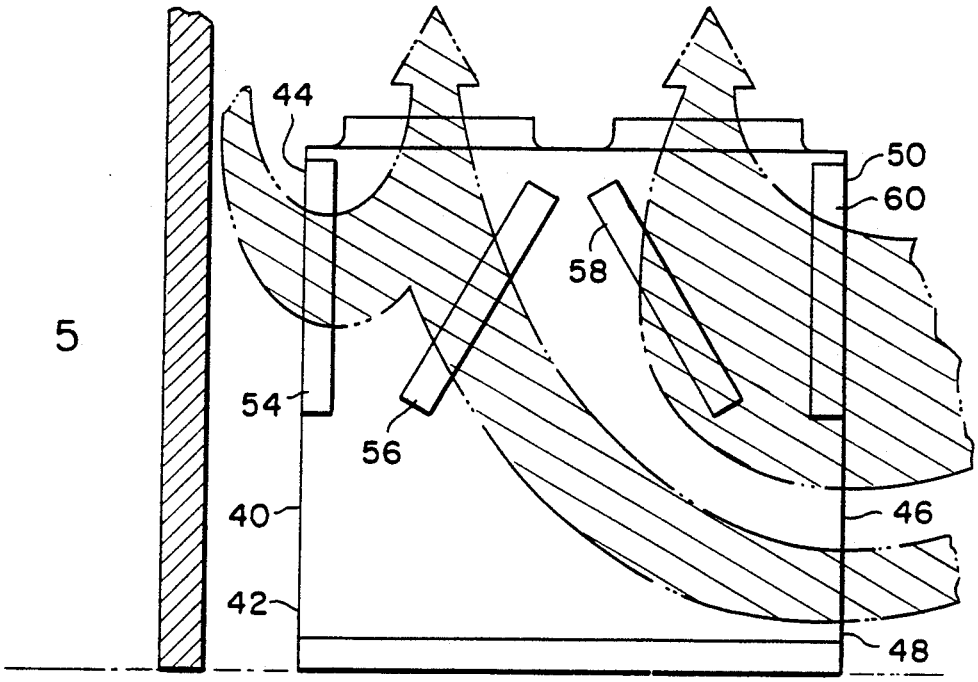
FIG. 5 is an operational view of the coil arrangement of FIG. 3 showing obstructed operation.

FIGS. 4 and 5 illustrate this where a comparison of an unobstructed condenser in accordance with the present invention is made to an obstructed condenser also in accordance with the present invention. FIG. 4 shows normal. unobstructed operation. In FIG. 5 an obstruction such as a wall is placed in close proximity to a first side 40 of the chiller housing 12 partially or completely obstructing airflow. Airflow from the air inlet 48 supplies air to the inner condenser coils 56 and 58 while air inlet 50 supplies air to the coil 60. If the obstruction is only partial as shown in FIG. 5 some airflow will enter coil 54 by means of air inlet 44 thus providing approximately 80% airflow efficiency where previous coil arrangements might achieve only 50 to 60% airflow efficiency. If the obstruction is complete, condenser coils 56, 58 and 60 will continue to operate normally while no airflow will be possible through condenser coil 54. Thus, with 50% air inlet blockage, the condenser will continue to operate at 75% efficiency.

The present invention provides a modified "W" condenser coil arrangement where the inner coils are inwardly spaced from the exterior coils thereby eliminating an abrupt 90 degree airflow turn. Consequently airflow is consistent across the inner coils and essentially has a constant face velocity. The arrangement also eliminates the lower pinched "V" which is present in both the previous "V" and in the "deep W" arrangements. This has the effect of eliminating an area of poor airflow at the base of each "V". This area of poor airflow essentially results from impinging airflows from each leg of the "V" where the air attempts to enter at the pinched "V" base. Spacing of the exterior coils from the interior coils in the form of a modified "W" eliminates this problem.

Although complete blockage of an air inlet is unusual in actual practice in that airflow is usually retarded in direct proportion to the proximity of the obstruction, complete blockage has been assumed in the examples described herein as it facilitates efficiency comparisons. Thus the invention has thus been described in terms of a modified "W" arrangement where the obstruction of 50% of the air inlets provides at least a 75% airflow efficiency.

Although the preferred embodiment is described above, it is apparent that many alterations and modifications may be made without departing from the subject invention. Such modifications could include the spacing between the exterior and interior coils as well as the slant of the interior coils. Clearly the longitudinal distance of the coils can vary in accordance with system design requirements. It is intended that all such alterations and modifications be considered to be within the scope and spirit of the invention as defined in the following claims.

What is claimed and desired to be secured by Letters Patent of the United States is:

1. A condenser for an air conditioning or refrigeration system having first, second, third and fourth condenser coils arranged in a substantially W-shaped arrangement wherein the first and fourth coils are substantially perpendicular to a condenser base and are respectively located on an exterior side of the second and third coils.

2. The condenser of claim 1 wherein the second and third coils are located between the first and fourth coils in the shaped of an inverted "V".

3. The condenser of claim 2 wherein the angle of the second or third condenser coils with respect to a perpendicular is approximately 60 degrees plus or minus 15 degrees.

4. The condenser of claim 2 wherein the second and third coils contact each other.

5. The condenser of claim 2 wherein the second and third coils do not contact each other.

6. The condenser of claim 2 wherein the second coil is spaced from the first coil, and the third coil is spaced from the fourth coil, a distance directly proportional to the rate of condenser airflow.

7. The condenser of claim 1 wherein the condenser has an upper portion and a lower portion, and all of the condenser coils are substantially located in the upper portion.

8. The condenser of claim 1 further including means for providing 75% airflow efficiency when 50% of the air inlets are obstructed.

9. A condenser comprising:

a housing having a first and a second side;

first, second, third and fourth condenser coils located in said housing, the first coil being located in the first side, the fourth coil being located in the second side, the second coil being inwardly spaced from the first coil, the third coil being inwardly spaced from the fourth coil and the second and third coil being separated a greater distance from each other at their respective lower ends than at their respective upper ends wherein the condenser has a base and the first and fourth coils are substantially perpendicular to the base.

10. The condenser of claim 9 wherein the housing has an upper portion and a lower portion, and all of the condenser coils are substantially located in the upper portion.

11. A condenser for a refrigeration system comprising:

a housing including first and second air inlets;

four condenser coils located in said housing; and means for circulating air wherein three of the four coils are provided with air by either of said first or second air inlets wherein the air inlets are located on opposing sides of the housing.

12. The system of claim 11 wherein the air inlets are substantially parallel to two of the four condenser coils.

13. The system of claim 11 wherein the housing includes an upper portion and a lower portion, and the four condenser coils are substantially located in the upper portion.

14. A condenser arrangement for a refrigeration unit comprising:

a housing having a top, a first side and a second opposing side;

a plurality of fans located in the top of the housing;

a first air inlet located in the first side;

a second air inlet located in the second side; and first, second, third and fourth condenser coils arranged in a "W" shape when viewed from an axial direction where the first and fourth coils are respectively located in the first and second housing sides and the first and fourth coils are substantially vertical.

15. The condenser arrangement of claim 14 wherein the second and third coils are spaced inwardly from the first and fourth coils respectively.

16. The condenser arrangement of claim 15 where the degree of spacing is directly proportional to the rate of airflow of the condenser.

17. The condenser arrangement of claim 14 wherein the height of the first, second, third and fourth condenser coils is substantially less than the height of the first and second housing sides.

18. The condenser arrangement of claim 14 wherein the plurality of fans are located between the first and second coil and the between the third and fourth coil.

19. An air cooled chiller for an air conditioning system comprising:

a condenser having a base, air inlets on opposing sides and first, second, third and fourth condenser coils wherein the first and fourth coils are substantially perpendicular to the base and are respectively located on an exterior side of the second and third coils such that the condenser operates at 100% efficiency when either of the air inlets are located approximately four feet from an airflow obstruction.

20. The chiller of claim 19 wherein the condenser operates at 75% efficiency or greater when either of said air inlets are located less than four feet from an airflow obstruction.

21. The chiller of claim 20 wherein the condenser operates at 75% efficiency or greater when either of said air inlets is totally obstructed.

22. A method of assembling a condenser having a housing including a top, first and second opposing sides, and first, second, third and fourth condenser coils comprising the steps of:

locating the first coil in the first side substantially perpendicular to the top;

locating the fourth coil in the second side substantially perpendicular to the top; and locating the second and third coils between the first and fourth coils such that the second and third coils are arranged in an inverted "V".

23. The method of claim 22 including the further step of inwardly spacing the second and third coils from the first and fourth coils respectively a distance which is directly proportional to the rate of condenser airflow.

* * * * *

Disclaimer 5,067,560— Michael D. Carey, Holmen; William A. Smiley, III, Stoddard; Gerald A. Jansky, La Crosse, all of Wis. CONDENSER COIL ARRANGEMENT FOR REFRIGERATION SYSTEM. Patent dated November 26, 1991. Disclaimer filed January 30, 2001, by the assignee, American Standard Inc.

Hereby enters this disclaimer to claims 1, 2, 3, 4, and 22 of said patent.

*(Official Gazette, June 5, 2001)*

Disclaimer 5,067,560— Michael D. Carey, Holmen; William A. Smiley, III, Stoddard; Gerald Jansky, La Crosse, all of Wis. CONDENSER COIL ARRANGEMENT FOR REFRIGERATION SYSTEM. November 26, 1991. Disclaimer filed December 19, 2001, by the assignee, American Standard Inc.

Hereby enters this disclaimer to claims 7, 11, 12, 13, 14, 17, and 18 of said patent.

(*Official Gazette, March 26, 2002.*)